United States Patent [19]

Becker et al.

[11] Patent Number: 4,815,379

[45] Date of Patent: Mar. 28, 1989

[54] SHEET TRANSFER CYLINDER BETWEEN PRINTING UNITS OF A ROTARY PRINTING MACHINE

[75] Inventors: Willi Becker; Arno Wirz, both of Bammental, Fed. Rep. of Germany

[73] Assignee: Heidelberger Druckmaschinen AG, Heidelberg, Fed. Rep. of Germany

[21] Appl. No.: 7,004

[22] Filed: Jan. 27, 1987

[30] Foreign Application Priority Data

Jan. 24, 1986 [DE] Fed. Rep. of Germany ..... 3602084

[51] Int. Cl.[4] ..... B41F 21/04

[52] U.S. Cl. ..... 101/246; 101/420

[58] Field of Search ..... 101/216, 246, 228, 407 A, 101/420; 34/114, 120; 271/82, 277, 251; 226/24, 27, 32, 40, 41

[56] References Cited

U.S. PATENT DOCUMENTS

| | | | |
|---|---|---|---|
| 139,229 | 5/1873 | Barth | 101/409 |
| 1,306,086 | 6/1919 | Turck | 101/183 |
| 1,365,933 | 1/1921 | Mills | 101/409 |
| 2,226,315 | 12/1940 | Mailander | 101/420 |
| 2,280,663 | 4/1942 | Quick | 271/82 |
| 3,096,088 | 7/1963 | Young | 271/277 |
| 3,654,861 | 4/1972 | Rudolph | 101/183 |
| 3,986,455 | 10/1976 | Jeschke | 101/409 |
| 4,667,952 | 5/1987 | Jeschke | 271/82 |

FOREIGN PATENT DOCUMENTS

| | | | |
|---|---|---|---|
| 724129 | 8/1942 | Fed. Rep. of Germany | 101/216 |
| 1174801 | 7/1964 | Fed. Rep. of Germany | 101/183 |
| 961106 | 11/1949 | France | 271/51 |
| 527397 | 10/1940 | United Kingdom | 271/51 |

*Primary Examiner*—Clifford D. Crowder

*Attorney, Agent, or Firm*—Herbert L. Lerner; Laurence A. Greenberg

[57] ABSTRACT

A rotary printing press having an assembly of at least two printing units and a sheet transfer cylinder located between the printing units and having a plurality of gripper rows arranged symmetrically at the circumference of the cylinder, the sheet transfer cylinder includes a device for defining guide surfaces disposed between the gripper rows within the circumference of the cylinder and extending at least approximately as secants to the circumference of the cylinder.

7 Claims, 4 Drawing Sheets

SHEET TRANSFER CYLINDER BETWEEN PRINTING UNITS OF A ROTARY PRINTING MACHINE

The invention relates to an assembly of a sheet transfer cylinder between printing units of a rotary printing machine, the sheet transfer cylinder having a plurality of gripper rows arranged symmetrically at the circumference of the cylinder.

The cylindrical casing of such a sheet transfer cylinder is either formed of closed plate-shaped segment elements which are provided between the gripper rows or of web-shaped segment elements which also have the purpose of carrying and conveying the rather nonstiff i.e. soft, sheet (German Pat. No. 34 47 596 6-27). If print is applied to stiffer material in such a sheet-fed printing machine, a possibility of providing the sheet transfer cylinder with a greater diameter arises so that e.g. three sheet carrying surfaces with gripper rows are provided. This measure does not suffice, however, when printing stiff cardboard, because the end of the cardboard sheet extends away stiffly from the surface of the cylinder casing so that there is a risk of the printed image being smeared, especially when the cardboard sheet is being transferred from a sheet transfer cylinder to an impression cylinder. Presuming that such stiff sheets receive top quality printing, as is required, for example, for producing packaging, a damaged printed sheet is not acceptable.

Proceeding from the foregoing, it is an object of the invention to provide a sheet transfer cylinder which permits smear-free and mackling-free processing of a range of regular paper thicknesses up to thick cardboard.

With the foregoing and other objects in view, there is provided, in accordance with the invention, in a rotary printing press having an assembly of at least two printing units and a sheet transfer cylinder located between the printing units and having a plurality of gripper rows arranged symmetrically at the circumference of the cylinder, a sheet transfer cylinder comprising means for defining guide surfaces disposed between the gripper rows within the circumference of the cylinder and extending at least approximately as secants to the circumference of the cylinder.

Due to the use of guide surfaces provided between the gripper rows in the cylinder body, a free space is formed in which the trailing end of a stiff sheet can relax without damage to the printed sheet side. The trailing edge of the sheet is thereby purposefully passed along the guide plates after its transfer to the next cylinder. Thus, the construction of the sheet transfer cylinder according to the invention also permits the printing of stiff cardboard sheets without running the risk of damaging the printed image.

In accordance with another feature of the invention, the means for defining the guide surfaces are guide plates bent radially inwardly towards the center of the cylinder, the bent guide plates being disposed so as to support a trailing edge of a stiff sheet after take-over of the sheet by an impression cylinder following the sheet transfer cylinder, the bent guide plates forming with the trailing edge portion a wedge-shaped hollow space for producing an air pocket therein.

In accordance with an added feature of the invention, the means for defining the guide surfaces are part of a cylinder body of the sheet transfer cylinder, the guide surfaces being bent radially inwardly towards the center of the cylinder, the guide surfaces being disposed so as to support a trailing edge of a stiff sheet after take-over of the sheet by an impression cylinder following the sheet transfer cylinder, the guide surfaces forming together with the trailing edge portion a wedge-shaped hollow space for producing an air pocket therein.

In accordance with a further feature of the invention, there is provided a blow tube located outside the sheet transfer cylinder for directing an air flow towards the sheet, the guide surfaces and into the hollow space.

In accordance with an additional feature of the invention, the means for defining the guide surfaces comprise air paddles for applying the sheet to a sheet guiding device disposed outside the sheet transfer cylinder at a slight spacing from an outer cylindrical surface of the cylinder.

In accordance with still another feature of the invention, the guide plates are adjustably fastened by screws to a support body of the sheet transfer cylinder.

In accordance with still an added feature of the invention, the guide plates are formed with air slits having openings adjustable for controlling pressure of the air pocket.

In accordance with still a further feature of the invention, the guide plates are formed as guide stirrups In accordance with still an additional feature of the invention, the guide plates are formed as guide tongues In accordance with a concomitant feature of the invention, sheet-supporting elements forming the circumference of the cylinder are hangingly fastened between the gripper rows and are mounted on supports by snap closures.

Handling and operation of the assembly according to the invention is simplified and transport or conveyance of the sheets, is improved. The guide plates thus act as air paddles or vanes which, in combination with the air accumulated in the wedge-like hollow space, keep the printed sheet side away from the guide plates.

Other features which are considered as characteristic for the invention are set forth in the appended claims.

Although the invention is illustrated and described herein as embodied in a sheet transfer cylinder between printing units of a rotary printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
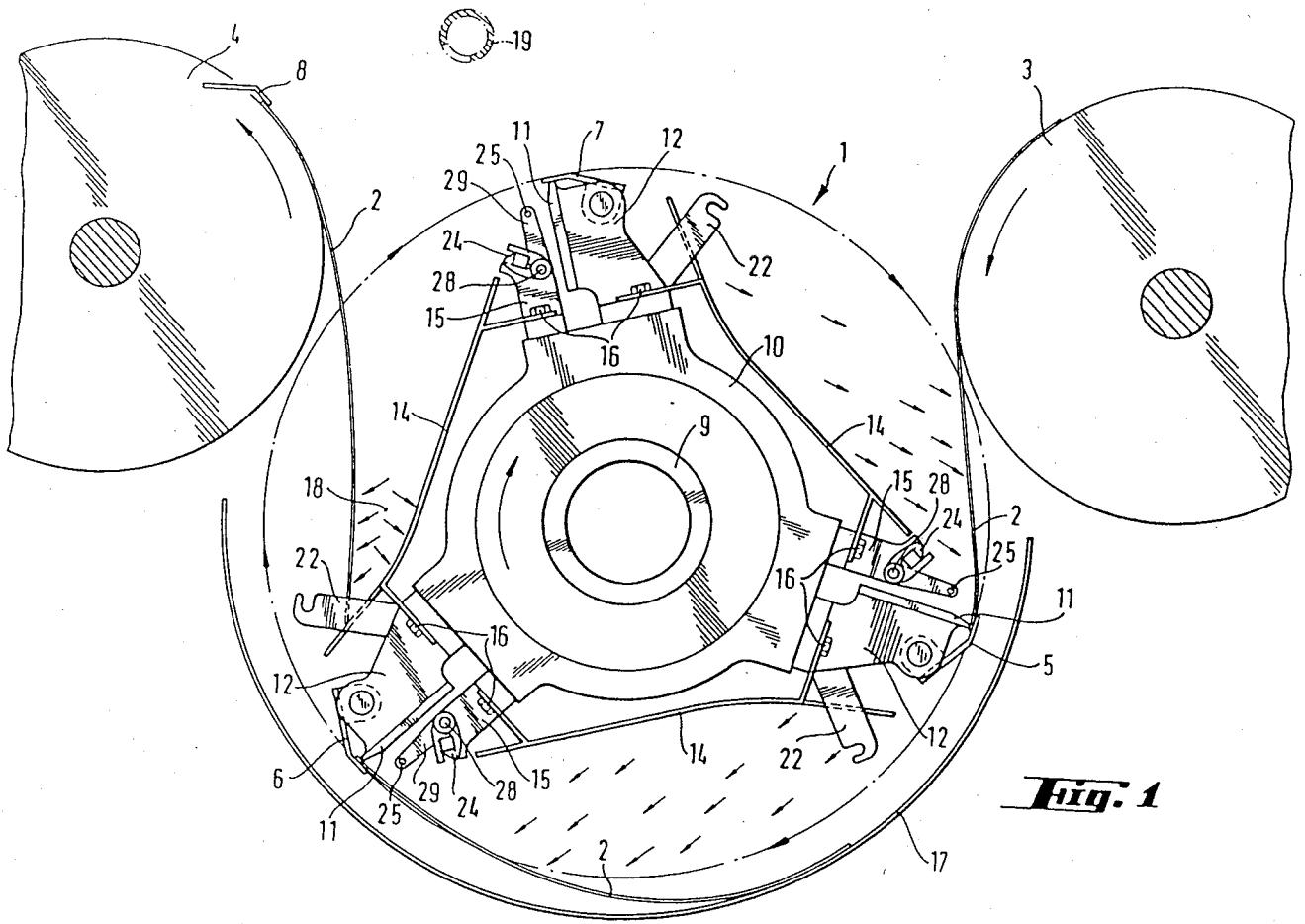
FIG. 1 is a diagrammatic side elevational view of a sheet transfer cylinder constructed in accordance with the invention.

Referring now to the drawing and, more particularly, to FIG. 1 thereof, there is shown between the printing units in tandem of a rotary printing machine, a sheet transfer cylinder 1 which takes over printing sheets 2 from an impression cylinder 3 and transfers them to a following impression cylinder 4 of the next printing unit. For transferring the sheets, the sheet transfer cylinder is provided with gripper rows 5, 6, 7 which take over the sheets from the grippers of the printing or impression cylinder 3 and transfer them to the grippers 8 of the following printing or impression cylinder 4. As is generally known, a blanket cylinder, a printing or impression cylinder, a plate cylinder and a sheet transfer cylinder are mounted between the machine side frames of a respective printing unit in a conventional manner and are drivingly coupled via meshing spur gears.

The sheet transfer cylinder 1 is formed of a shaft 9 rotatably mounted in the machine side frames (not shown), a support body 10 being fastened to each side of the shaft 9. The support body 10 can also be constructed as a cylinder body with journals.

Gripper bearing rails 11 for the gripper rows 5–7 are fastened, in turn, to the supporting body 10 via bearing members 12. The grippers are controlled in a conventional manner e.g. via cams and cam rollers, so that the fed sheet is taken over at the median line between the printing or impression cylinder 3 and the sheet transfer cylinder 1 and is delivered or surrendered at the median line between the sheet transfer cylinder 1 and the printing or impression cylinder 4.

In the embodiment according to FIG. 1, there are provided within the cylinder circumference and between the gripper rows 5–7 guide plates 14 which are shaped inwardly towards the center of the cylinder so as to form a hollow space for producing an air accumulation or pocket. The surfaces of the guide plates 14 extend substantially as secants to the cylinder circumference and are bent towards the center of the cylinder. The guide plates 14 are fastened e.g. by means of screws 16, to the bearing bodies 12 and holders 15, respectively, for sheet supporting elements 13.

If thicker sheets of paper or stiff cardboard sheets are printed with such a sheet transfer cylinder, the rear regions of those sheets can relax into the free space formed by the guide plates 14, and the sheets are purposefully passed along the guide plate 14 with the trailing edges thereof after having been transferred to the next cylinder 4. In so doing, smearing of the freshly printed sheet side is avoided. Furthermore, ink repellant sheet supporting elements, which would have to be washed at regular intervals, are not required Besides, the printer is not forced to adjust sheet supporting elements to the free locations of the printed image or even to use expensive special printing inks After the sheet take-over, the guide plates 14 extending over the width of the cylinder act as air paddles or vanes whereby the air applies the sheet with it s non-printed side to sheet guiding devices 17, which are arranged outside the sheet transfer cylinder 1, and thereby stabilizing the sheer. Thus, supporting the sheet is unnecessary, and the risk of smearing is avoided. Both sides of the sheet-guiding device 17 are fastened to the machine side frames in a conventional manner.

After having transferred the printed sheet 2 to the following printing or impression cylinder 4, the guide plates 14, together with the trailing end of the sheet 2, form a narrowing wedge-shaped hollow space 18 in which air is accumulated. This air accumulation or pocket prevents the printed side of the sheet from abutting against the guide plate 14. Only the trailing sheet edge is passed along the guide plate 14 by the rotary motion of the sheet transfer cylinder and the printing or impression cylinder. If slits for the guide plates 14 are provided in the region of the fastening screws 16, they can be reset and thus adjusted to different sorts of paper.

Figure 2:
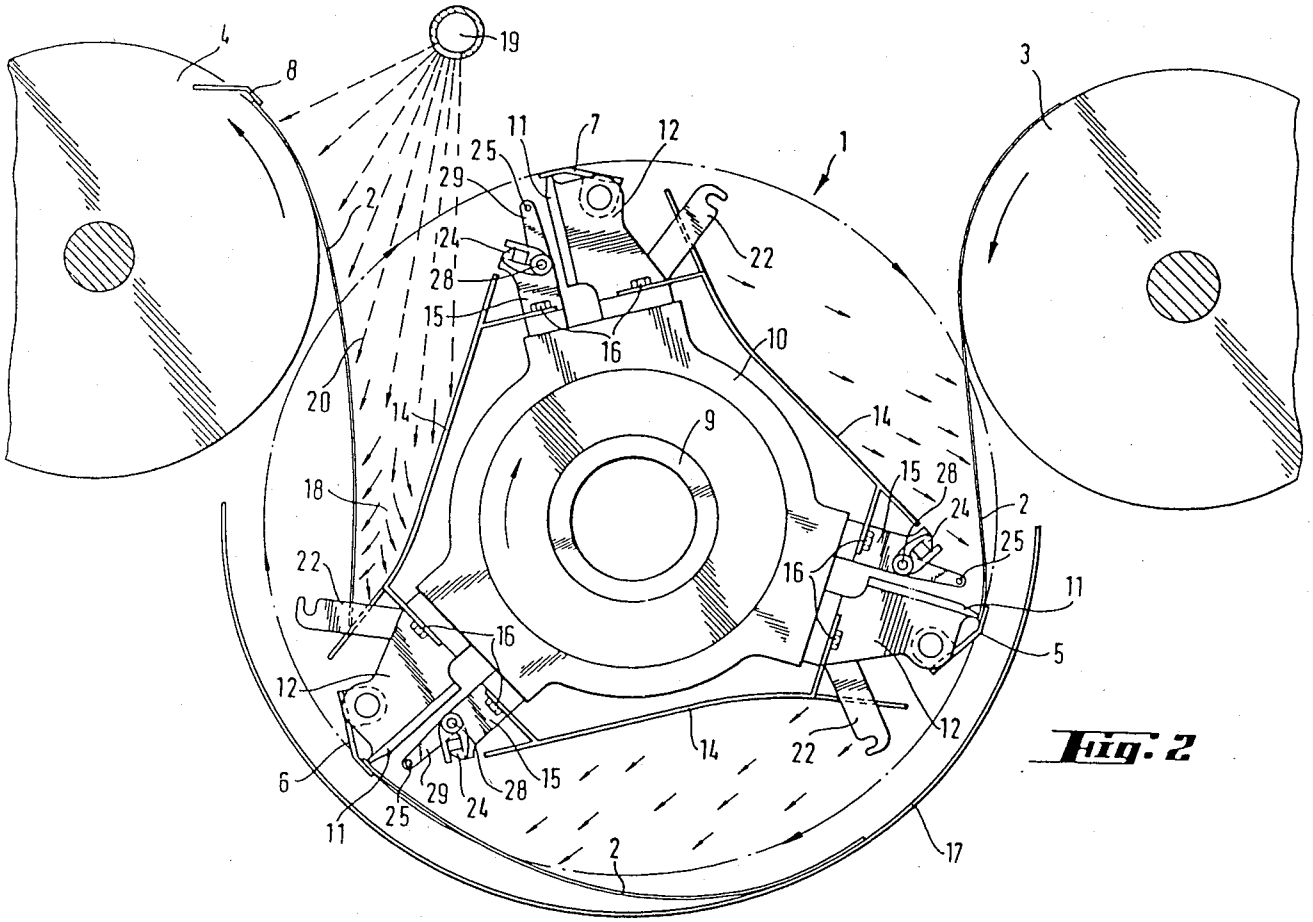
FIG. 2 is a view of the sheet transfer cylinder similar to that of FIG. 1, however, with an additional blowing airflow.

Between the sheet transfer cylinder 1 and the printing or impression cylinder 4 and spaced a slight distance therefrom, in the embodiment according to FIG. 2, a blowing tube 19 is provided which directs an air flow 20 into the wedge-shaped hollow space and increases or reinforces the accumulation of air. Instead of guide plates 14, the use of guiding stirrups or guiding tongues is also possible, when processing, for example, only very stiff cardboard. Furthermore, for purposefully reducing the pressure of the air accumulation in the wedge-shaped hollow space 18, the guide plates 14 can be provided with openings, e.g. in the form of closable air slits, the pressure of the accumulated air being adjustable to different materials.

Figure 3:
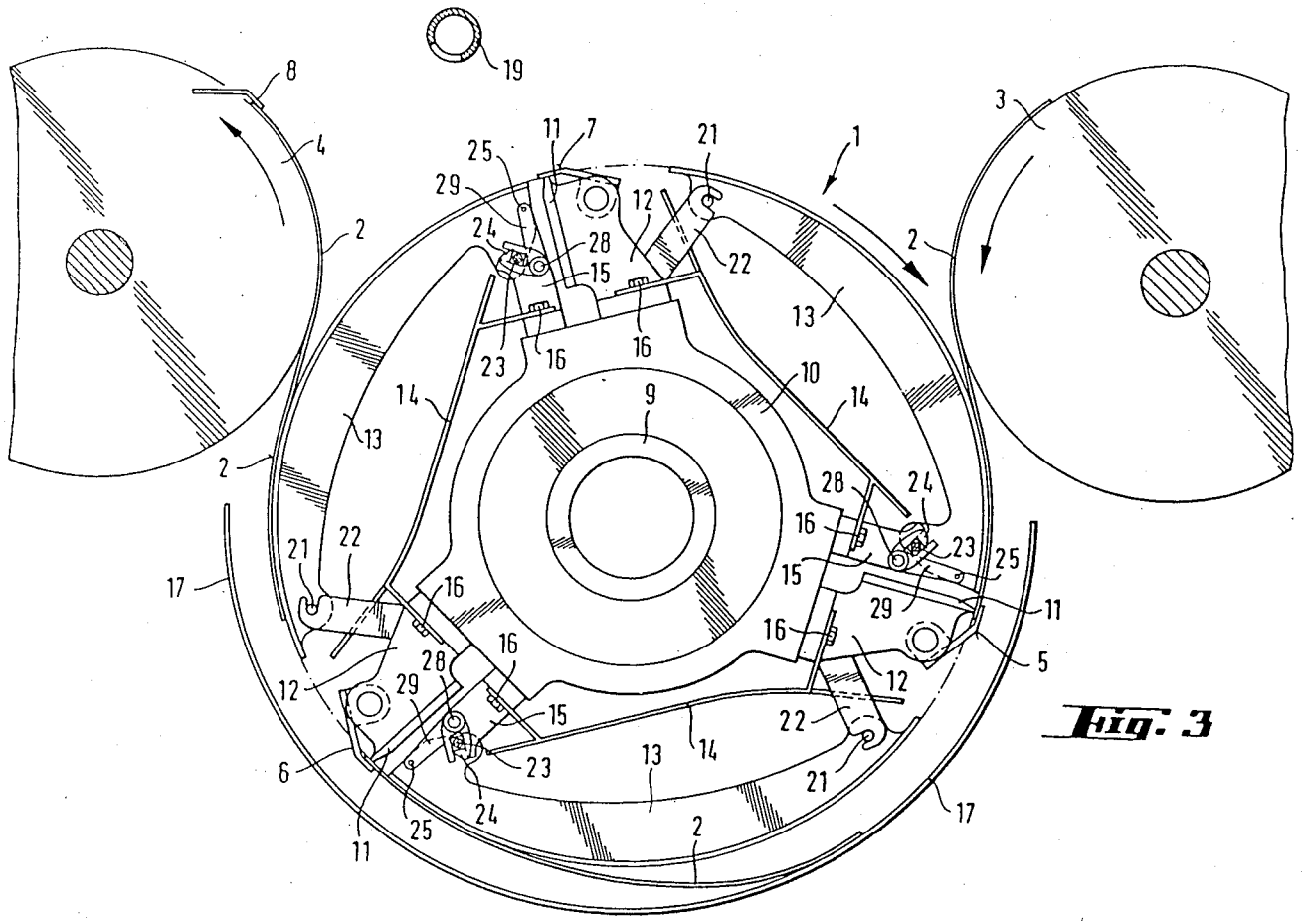
FIG. 3 is a further side-elevational view of the sheet transfer cylinder with sheet supporting elements forming the cylinder casing.

In FIG. 3, sheet supporting elements 13 having supporting surfaces which form the cylinder casing are inserted into the sheet transfer cylinder 1 between the gripper rows 5, 6 and 7 for processing thin, soft sheets 2. In this case, the supporting surfaces can be constructed so as not to take over any ink from the freshly printed sheets. With these printing jobs, the guide plates 14 can remain in the sheet transfer cylinder 1 below the sheet supporting elements. The sheet supporting elements 13 can be constructed so as to extend continuously over the entire length of the cylinder or can be constructed in the form of webs, and one side of each of these sheet supporting elements 13 is hooked into a slotted holder 22 via a bolt 21. On the other side thereof, the sheet supporting elements 13 are suspended from the fork-like construction of the holder 15 also via a bolt 23 and secured by means of a hook 24 in the manner of a snap closure. The hook 24 is fastened to a spindle 28 and is pivoted into the snapped or holding position under spring pressure Moreover, a pivoting lever 29 carrying a spring bolt 25 is fastened to one side of the spindle 28. When inserting the sheet supporting element 13, the bolt 23 causes the hook 24 to open and to snap automatically. In the snapped or closed position, the spring bolt 25 is snapped, for additional safety, into a bore formed in the sheet supporting element 13. For fast exchange of the sheet supporting elements 13, the spring bolt 25 is unlocked and the hook 24 is opened via the pivoting lever 29 so that the sheet supporting element 13 can be removed. Owing to such a sheet transfer cylinder 1 of circular construction, even extremely thin and unstable sheets of paper can be transferred in register during an undisturbed paper run. The removable sheet supporting elements can be made ready outside the machine for the next printing job so that the changeover times of the machine can be reduced.

Figure 4:
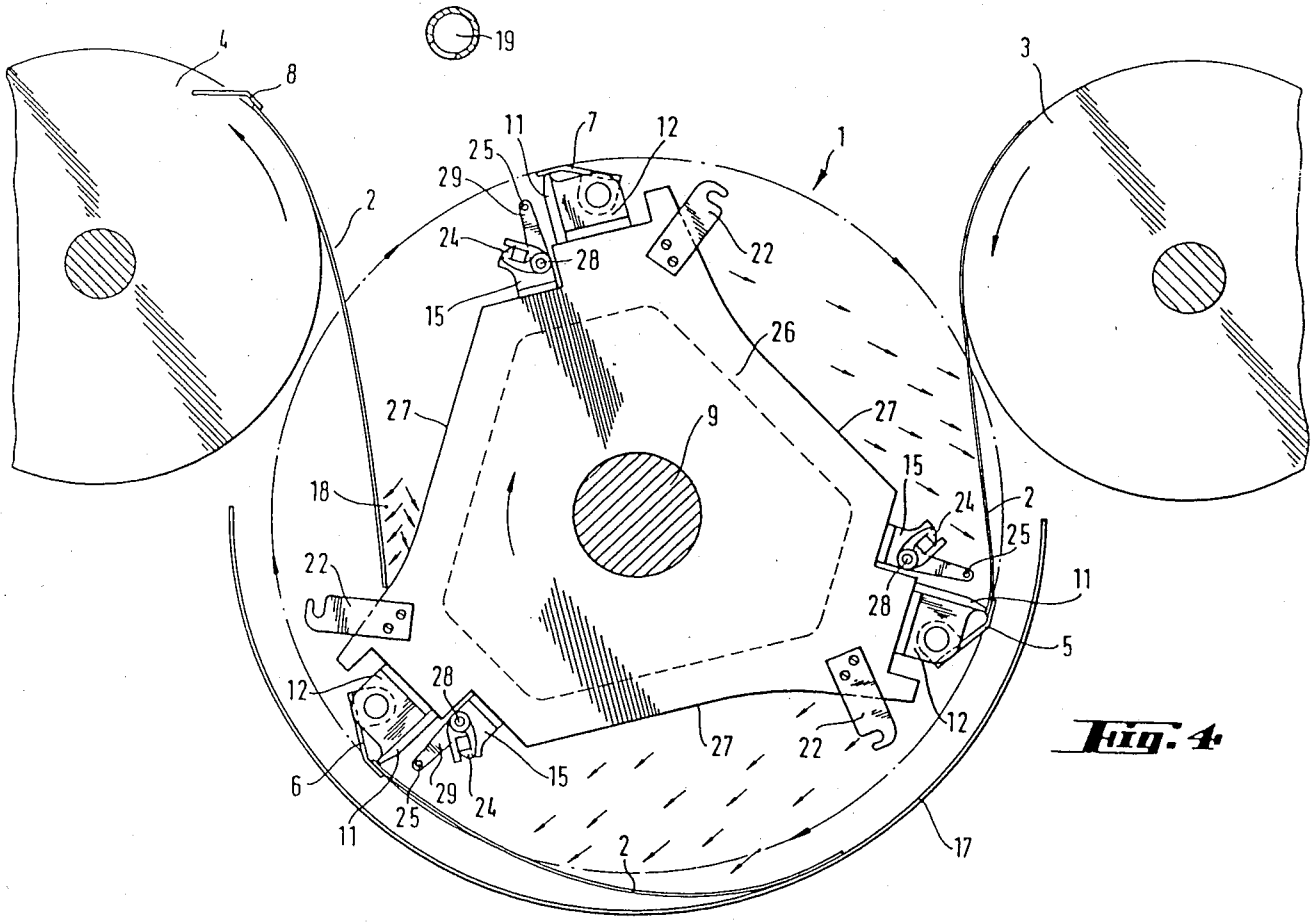
FIG. 4 is yet another side elevational view of a sheet transfer cylinder having a cylinder body in the form of the guide plates which may be provided in the interior thereof.

FIG. 4 differs from the embodiments described hereinbefore in that the sheet transfer cylinder 1 is provided with a cylinder body 26 which, between the gripper rows 5, 6 and 7, is provided with guide surfaces 27 corresponding to the guide plates 14. With this embodiment, the same advantages and effects are obtained as in the case of the guide plates 14 and, in the same manner, sheet supporting elements 13 can be additionally inserted, if the pressman has to perform such a printing job.

The foregoing is a description corresponding in substance to German Application Pat. No. 36 02 084.2, dated Jan. 24, 1986, the International priority of which is being claimed for the instant application, and which is hereby made part of this application. Any material discrepancies between the foregoing specification and the aforementioned corresponding German application are to be resolved in favor of the latter.

We claim:

1. In a rotary printing press having an assembly of at least two printing units and a sheet transfer cylinder located between the printing units and having a plurality of gripper rows arranged symmetrically at the circumference of the cylinder, the sheet transfer cylinder comprising means for defining closed and continuous guide surfaces disposed between the gripper rows within the circumference of the cylinder and extending at least approximately as secants to the circumference of the cylinder across the width of the cylinder, said guide surfaces being disposed so as to support a trailing edge of a stiff sheet and so as to define therewith a wedge-shaped hollow space forming an air pocket after take-over of the sheet by an impression cylinder following the sheet transfer cylinder.

2. Assembly according to claim 1, including a blow tube located outside the sheet transfer cylinder for directing an air flow towards the sheet, said guide surfaces and into said hollow space.

3. Assembly according to claim 1, wherein said guide surfaces comprise air paddles for applying the sheet at an unprinted face thereof to a sheet guiding device disposed outside the sheet transfer cylinder at a slight spacing from an outer cylindrical surface of the cylinder.

4. Assembly according to claim 1, wherein said guide surface are on guide plates adjustably fastened by screws to a support body of the sheet transfer cylinder.

5. Assembly according to claim 1, wherein said guide surface are on guide plates formed with air slits having openings adjustable for controlling pressure of the air pocket.

6. Assembly according to claim 1, wherein sheet-supporting elements forming the circumference of the cylinder are hangingly fastened between the gripper rows and are mounted on supports by snap closures.

7. In a rotary printing press having an assembly of at least two printing units and a sheet transfer cylinder located between the printing units and having a plurality of gripper rows arranged symmetrically at the circumference of the cylinder, the sheet transfer cylinder comprising a cylinder body formed with closed and continuous guide surfaces disposed between the gripper rows within the circumference of the cylinder and extending at least approximately as secants to the circumference of the cylinder across the width of the cylinder, said guide surfaces being formed with a bend towards the middle of the cylinder and being disposed so as to support a trailing edge of a stiff sheet and to define therewith a wedge-shaped space forming an air pocket after take-over of the sheet by an impression cylinder following the sheet transfer cylinder.

* * * * *